US010408080B2

(12) United States Patent
Rioux et al.

(10) Patent No.: US 10,408,080 B2
(45) Date of Patent: Sep. 10, 2019

(54) TAILORED THERMAL CONTROL SYSTEM FOR GAS TURBINE ENGINE BLADE OUTER AIR SEAL ARRAY

(71) Applicant: United Technologies Corporation, Hartford, CT (US)

(72) Inventors: Philip R. Rioux, North Berwick, ME (US); Neil L. Tatman, Brentwood, NH (US)

(73) Assignee: United Technologies Corporation, Farmington, CT (US)

( * ) Notice: Subject to any disclaimer, the term of this patent is extended or adjusted under 35 U.S.C. 154(b) by 540 days.

(21) Appl. No.: 15/023,593

(22) PCT Filed: Oct. 6, 2014

(86) PCT No.: PCT/US2014/059308
§ 371 (c)(1),
(2) Date: Mar. 21, 2016

(87) PCT Pub. No.: WO2015/102702
PCT Pub. Date: Jul. 9, 2015

(65) Prior Publication Data

US 2016/0273376 A1 Sep. 22, 2016

Related U.S. Application Data

(60) Provisional application No. 61/887,760, filed on Oct. 7, 2013.

(51) Int. Cl.
*F01D 11/18* (2006.01)
*F01D 25/24* (2006.01)

(52) U.S. Cl.
CPC ..... *F01D 11/18* (2013.01); *F01D 25/246* (2013.01); *F05D 2240/307* (2013.01); *F05D 2250/182* (2013.01); *F05D 2300/50212* (2013.01)

(58) Field of Classification Search
CPC ..... F01D 11/18
See application file for complete search history.

(56) References Cited

U.S. PATENT DOCUMENTS 4,411,594 A 10/1983 Pellow et al.
4,527,385 A 7/1985 Jumelle et al.
(Continued)

FOREIGN PATENT DOCUMENTS

DE 10251468 A1 5/2004

OTHER PUBLICATIONS

EP search report for EP14877357.5 dated Sep. 26, 2016.

*Primary Examiner* — Jason D Shanske
*Assistant Examiner* — Jason G Davis
(74) *Attorney, Agent, or Firm* — O'Shea Getz P.C.

(57) ABSTRACT

A clearance control ring for a clearance control system of a gas turbine engine includes a contoured radial outer portion that defines a multiple of fins and a multiple of slots. A clearance control system of a gas turbine engine includes a clearance control ring with a radial inner portion from which a contoured radial outer portion extends. The contoured radial outer portion defines a multiple of fins and a multiple of slots. A blade outer air seal assembly with a clearance control ring land which receives the radial inner portion. A method of controlling a radial tip clearance within a gas turbine engine includes tailoring a multiple of fins and a multiple of slots of a clearance control ring for both steady state and transient clearance operations.

7 Claims, 4 Drawing Sheets

(56) References Cited

U.S. PATENT DOCUMENTS

| | | | | |
|---|---|---|---|---|
| 4,863,345 | A | 9/1989 | Thompson et al. | |
| 5,154,575 | A * | 10/1992 | Bonner | F01D 11/18 415/134 |
| 6,120,242 | A | 9/2000 | Bonnoitt et al. | |
| 7,491,029 | B2 * | 2/2009 | Pezzetti, Jr. | F01D 11/24 415/1 |
| 2005/0031446 | A1 | 2/2005 | Ress, Jr. et al. | |
| 2006/0165518 | A1 | 7/2006 | Albers et al. | |
| 2006/0239816 | A1 | 10/2006 | Labbe et al. | |
| 2012/0247124 | A1 | 10/2012 | Shapiro et al. | |
| 2014/0260218 | A1 * | 9/2014 | Deckers | F01K 23/10 60/320 |

* cited by examiner

TAILORED THERMAL CONTROL SYSTEM FOR GAS TURBINE ENGINE BLADE OUTER AIR SEAL ARRAY

CROSS-REFERENCE TO RELATED APPLICATION

This application claims priority to PCT Patent Application No. PCT/US14/59308 filed Oct. 6, 2014, which claims priority to U.S. Provisional Application Ser. No. 61/887,760 filed Oct. 7, 2013, which are hereby incorporated herein by reference in their entireties.

BACKGROUND

The present disclosure relates to a gas turbine engine and, more particularly, to a blade tip clearance control system therefor.

Gas turbine engines, such as those that power modern commercial and military aircraft, generally include a compressor to pressurize an airflow, a combustor to burn a hydrocarbon fuel in the presence of the pressurized air, and a turbine to extract energy from the resultant combustion gases. The compressor and turbine sections include rotatable blade and stationary vane arrays. Within an engine case structure, the radial outermost tips of each blade array are positioned in close proximity to a shroud assembly. Blade Outer Air Seals (BOAS) supported by the shroud assembly are located adjacent to the blade tips such that a radial tip clearance is defined therebetween.

When in operation, the thermal environment in the engine varies and may cause thermal expansion and contraction such that the radial tip clearance varies. The radial tip clearance may be influenced by mechanical loading, e.g., radial expansion of the blades and/or their supporting disks due to speed-dependent centrifugal loading and relative thermal expansion, e.g., of the blades/disks on the one hand and the non-rotating structure on the other. The radial tip clearance is typically designed so that the blade tips do not rub against the BOAS under high power operations when the blade disk and blades expand as a result of thermal expansion and centrifugal loads. When engine power is reduced, the radial tip clearance increases. The leakage of core air between the blade tips and the BOAS may have a negative effect on engine performance/efficiency, fuel burn, and component life.

To facilitate engine performance, at least some engines include a blade tip clearance control system to maintain a close radial tip clearance. To provide active control, some systems form the non-rotating structure with a circumferential array of BOAS mounted for controlled radial movement, e.g., via actuators such as electric motors or pneumatic actuators. An aircraft or engine control system may control the movement to maintain a desired tip clearance between the inner diameter faces of the BOAS and the blade tips. Additionally, various proposed systems have involved tailoring the physical geometry and material properties of the BOAS support structure to tailor the thermal expansion and provide a desired clearance when conditions change. Such thermal systems may be passive. Alternatively, such thermal systems may involve an element of active control such as selective cooling of cooling air to the support structure.

SUMMARY

A clearance control ring for a clearance control system of a gas turbine engine, according to one disclosed non-limiting embodiment of the present disclosure, includes a contoured radial outer portion that defines a multiple of fins and a multiple of slots.

In a further embodiment of the present disclosure, the contoured radial outer portion has an axial thickness greater than a radial inner portion from which the contoured radial outer portion extends.

In a further embodiment of any of the foregoing embodiments of the present disclosure, the contoured radial outer portion and the radial inner portion define a cactus shape in cross-section.

In a further embodiment of any of the foregoing embodiments of the present disclosure, the multiple of fins and the multiple of slots are rectilinear in shape.

In a further embodiment of any of the foregoing embodiments of the present disclosure, the multiple of fins and the multiple of slots are triangular in shape.

In a further embodiment of any of the foregoing embodiments of the present disclosure, the multiple of fins and the multiple of slots are non-linear.

In a further embodiment of any of the foregoing embodiments of the present disclosure, a radial inner portion is included from which the contoured radial outer portion extends. The radial inner portion includes an inner surface with a multiple of feet.

In a further embodiment of any of the foregoing embodiments of the present disclosure, the multiple of feet are axially displaced.

In a further embodiment of any of the foregoing embodiments of the present disclosure, the multiple of feet are radially displaced.

A clearance control system of a gas turbine engine, according to another disclosed non-limiting embodiment of the present disclosure, includes a clearance control ring with a radial inner portion from which a contoured radial outer portion extends. The contoured radial outer portion defines a multiple of fins and a multiple of slots. A blade outer air seal assembly is included with a clearance control ring land which receives the radial inner portion.

In a further embodiment of any of the foregoing embodiments of the present disclosure, the blade outer air seal assembly is mechanically fastened to a gas turbine engine structure.

In a further embodiment of any of the foregoing embodiments of the present disclosure, the clearance control ring and the clearance control ring land define an interference fit.

In a further embodiment of any of the foregoing embodiments of the present disclosure, the radial inner portion includes an inner surface with a multiple of feet.

In a further embodiment of any of the foregoing embodiments of the present disclosure, the clearance control ring land defines a multiple of lands, one for each of the multiple of feet.

In a further embodiment of any of the foregoing embodiments of the present disclosure, the multiple of lands and the multiple of feet define a "dead" cavity therebetween.

In a further embodiment of any of the foregoing embodiments of the present disclosure, the multiple of feet are axially displaced.

A method of controlling a radial tip clearance within a gas turbine engine, according to another disclosed non-limiting embodiment of the present disclosure, includes tailoring a multiple of fins and a multiple of slots of a clearance control ring for both steady state and transient clearance operations.

In a further embodiment of any of the foregoing embodiments of the present disclosure, the method includes tailoring the multiple of fins and the multiple of slots to counteract a rolling motion of a blade outer air seal assembly.

In a further embodiment of any of the foregoing embodiments of the present disclosure, the method includes locating the multiple of fins and the multiple of slots in a contoured radial outer portion of the clearance control ring. The contoured radial outer portion extends from a radial inner portion that includes an inner surface with a multiple of feet.

In a further embodiment of any of the foregoing embodiments of the present disclosure, the method includes forming a "dead" cavity between the multiple of feet and a multiple of lands.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
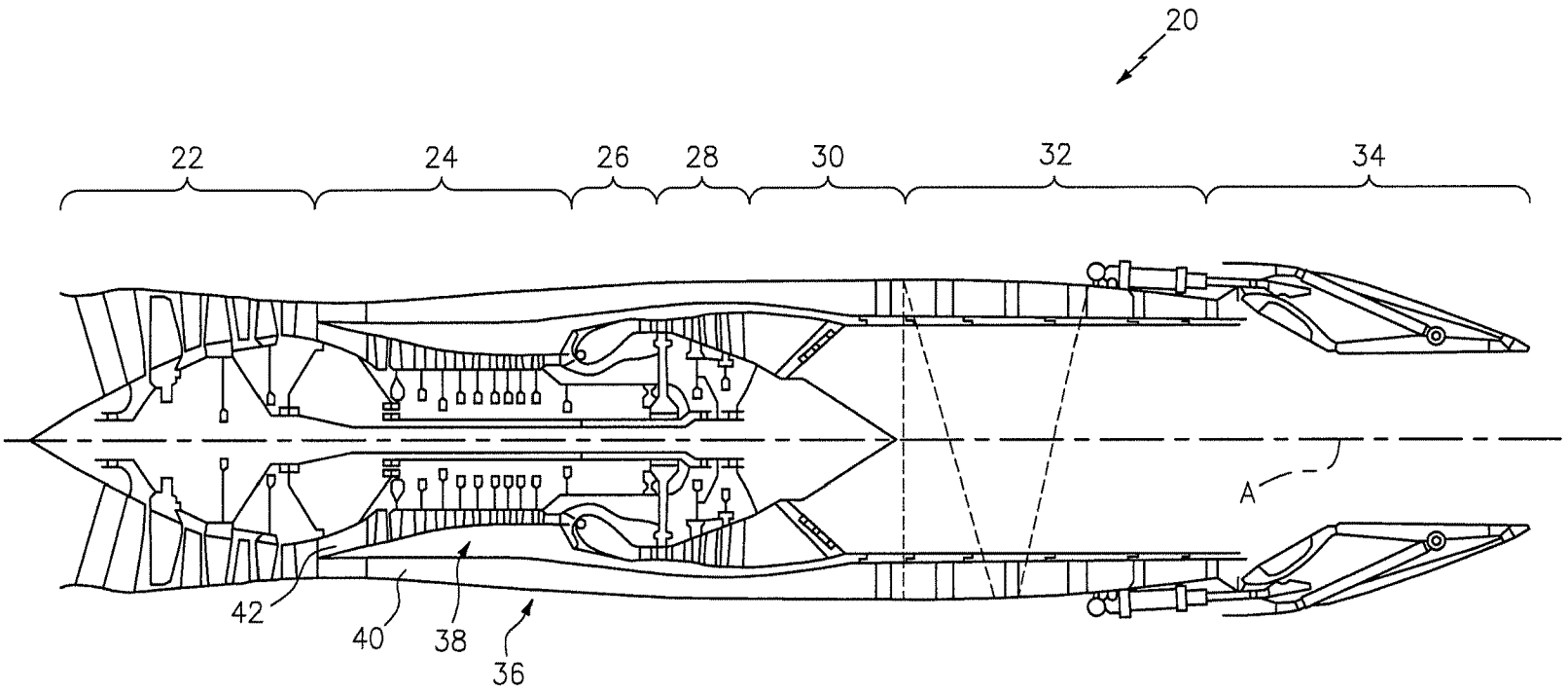
FIG. 1 is a schematic cross-section of one example aero gas turbine engine.

FIG. 1 schematically illustrates a gas turbine engine 20. The gas turbine engine 20 is disclosed herein as a two-spool low-bypass augmented turbofan that generally incorporates a fan section 22, a compressor section 24, a combustor section 26, a turbine section 28, an augmenter section 30, an exhaust duct section 32, and a nozzle system 34 along a central longitudinal engine axis A. Although depicted as an augmented low bypass turbofan in the disclosed non-limiting embodiment, it should be understood that the concepts described herein are applicable to other gas turbine engines to include but not be limited to non-augmented engines, geared architecture engines, direct drive turbofans, turbojet, turboshaft, multi-stream variable cycle adaptive engines and other engine architectures. Variable cycle gas turbine engines power aircraft over a range of operating conditions and essentially alters a bypass ratio during flight to achieve countervailing objectives such as high specific thrust for high-energy maneuvers yet optimizes fuel efficiency for cruise and loiter operational modes.

An engine case structure 36 defines a generally annular secondary airflow path 40 around a core airflow path 42. Various static structures and modules may define the engine case structure 36 that essentially defines an exoskeleton to support the rotational hardware.

Air that enters the fan section 22 is divided between core airflow through the core airflow path 42 and a secondary airflow through a secondary airflow path 40. The core airflow passes through the combustor section 26, the turbine section 28, then the augmentor section 30 where fuel may be selectively injected and burned to generate additional thrust through the nozzle system 34. It should be appreciated that additional airflow streams such as third stream airflow typical of variable cycle engine architectures may additionally be sourced from the fan section 22.

The secondary airflow may be utilized for a multiple of purposes to include, for example, cooling and pressurization. The secondary airflow as defined herein may be any airflow different from the core airflow. The secondary airflow may ultimately be at least partially injected into the core airflow path 42 adjacent to the exhaust duct section 32 and the nozzle system 34.

The exhaust duct section 32 may be circular in cross-section as typical of an axisymmetric augmented low bypass turbofan or may be non-axisymmetric in cross-section to include, but not be limited to, a serpentine shape to block direct view to the turbine section 28. In addition to the various cross-sections and the various longitudinal shapes, the exhaust duct section 32 may terminate in a Convergent/Divergent (C/D) nozzle system, a non-axisymmetric two-dimensional (2D) C/D vectorable nozzle system, a flattened slot nozzle of high aspect ratio or other nozzle arrangement.

Figure 2:
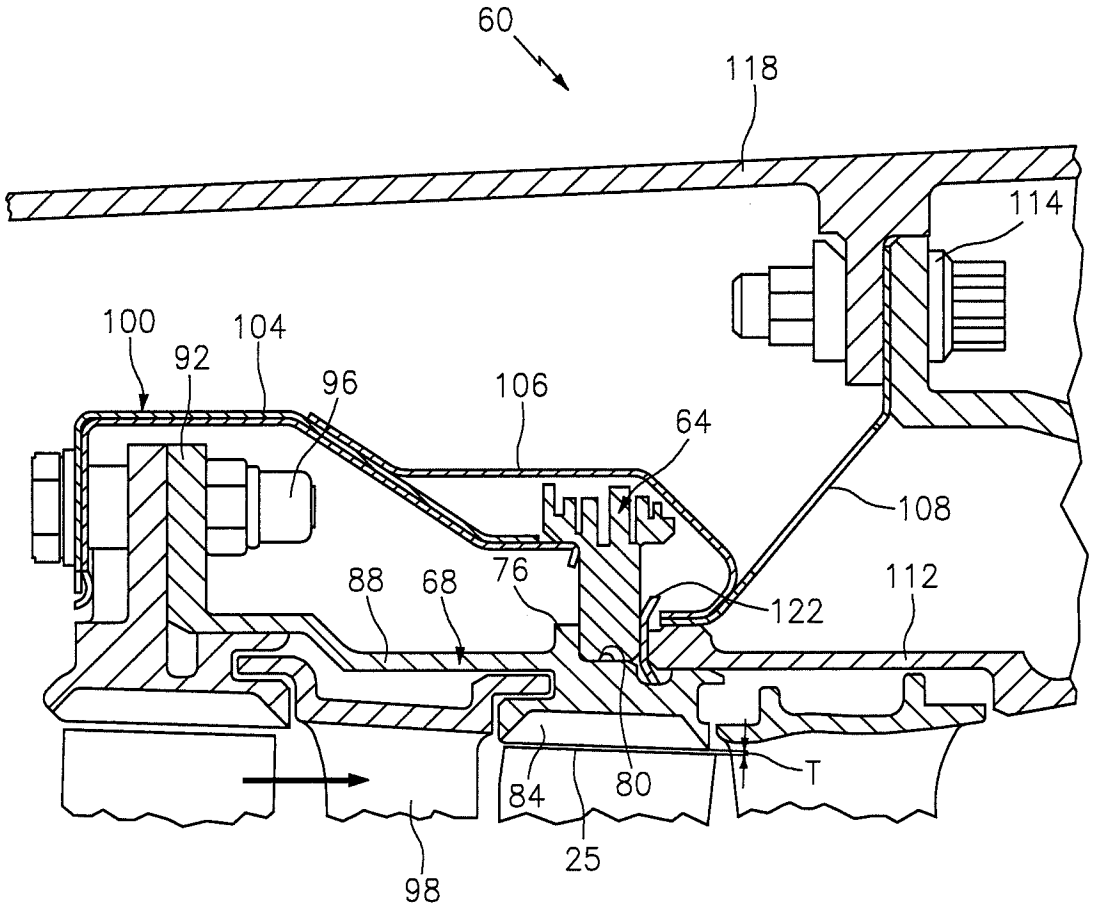
FIG. 2 is an is an enlarged partial sectional schematic view of a portion of a clearance control system according to one disclosed non-limiting embodiment.

With reference to FIG. 2, a blade tip clearance control system 60 according to one disclosed non-limiting embodiment includes a clearance control ring 64 that radially positions a blade outer air seal (BOAS) assembly 68 relative to blade tips 25 of one stage in the gas turbine engine 20. The BOAS system 60 locally bounds a radially outboard extreme of the core airflow path and is pressurized radially outward against the clearance control ring 64 during engine operation. The system 60 may be arranged around each or particular stages within the gas turbine engine 20. That is, each rotor stage in the compressor section 24 may have an independent system 60. In this disclosed non-limiting embodiment, the clearance control ring 64 is utilized to control tip clearances within the eighth stage of a high pressure compressor of the compressor section 24. In other examples, the clearance control ring 64 is used in other stages of the engine 20.

Thermal energy from the engine 20 causes the clearance control ring 64 and the BOAS assembly 68 to relatively expand and contract. In this disclosed non-limiting embodiment, a coefficient of thermal expansion (CTE) material of the clearance control ring 64 is less than a coefficient of thermal expansion (CTE) material of the BOAS assembly 68, e.g., a metal alloy such as a nickel-based superalloy. The clearance control ring 64 and BOAS assembly 68 are sized such that radial outward movement of the BOAS assembly 68 is constrained by the clearance control ring 64.

When contracted, the clearance control ring 64 limits radial movement of the BOAS assembly 68 away from the blade tips 25 to limit expansion of a radial clearance T between the BOAS assembly and the blade tip 25. When expanded, the clearance control ring 64 permits greater radial moment of the BOAS assembly 68 away from the blade tip 25.

The clearance control ring 64 and the BOAS assembly 68 can be constructed of different materials or different combinations of materials to achieve the different CTE. The example clearance control ring 64 is constructed of a material or materials that optimize clearance control. The material can be low alpha, low max temperature material. The example BOAS assembly 68 may be constructed from a material that is optimized for the relatively high temperatures adjacent the core airflow path.

The clearance control ring 64 may be a continuous ring structure that extends about the central longitudinal engine axis A. The clearance control ring 64, when installed, may be positioned against a ring flange 76 that extends radially from other portions of the BOAS assembly 68. The clearance control ring 64, when installed, is positioned radially onto a control ring land 80 of the BOAS assembly 68. The control ring land 80 defines at least one radial outer periphery of the control ring 64.

The BOAS assembly 68 may further include an abradable seal portion 84, an axial arm 88, and a radially extending fastener flange 92. A multiple of mechanical fasteners 96, such as bolts, secures the BOAS assembly 68 within the engine 20. The example mechanical fasteners 96 are received through respective apertures in the fastener flange 92. In this example, the radially extending fastener flange 92 and the seal portion 84 are positioned to span and at least partially retain a static airfoil 98 such as a vane.

The mechanical fastener 96 may further secure a heat shield assembly 100 within the engine 20. The heat shield assembly 100, according to one disclosed non-limiting embodiment, includes a forward heat shield 104, a mid heat shield 106 and an aft heat shield 108. The forward heat shield 104 extends from an upstream portion retained by the mechanical fastener 96 to a downstream portion that abuts the clearance control ring 64. The forward heat shield 104 includes a bi-layer structure in this example. The mid heat shield 106 extends from an area of the forward heat shield 104 to an area of the aft heat shield 108. The mid heat shield 106 extends from upstream of the clearance control ring 64 to a position downstream thereof. The aft heat shield 108 extends from a sandwiched interface between the mid heat shield 106 and an inner case 112 of the engine 20 to a mechanical fastener 114 that secures the aft heat shield 108 to an outer case 118 of the engine 20. The aft heat shield 108 is secured to the mid heat shield 106. The heat shield assembly 100 operates to thermally shield clearance control ring 64 but need not be required in some disclosed non-limiting embodiments.

To assemble the clearance control ring 64 on the land 80 in one disclosed non-limiting embodiment, the clearance control ring 64 may be heated relative to the BOAS assembly 68 to expand radially the clearance control ring 64. The clearance control ring 64 then cools and is compressed against the ring alignment flange 76 to form an interference fit. Alternatively, the clearance control ring 64 is slid axially onto the land 80 without being heated relative to the BOAS assembly 68.

After positioning the clearance control ring 64 on the land 80, the inner case 112 is then assembled. The clearance control ring 64 is constrained axially between the ring alignment flange 76 and the inner case 112. A spacer 122 may, optionally, be utilized to bias the clearance control ring 64 toward, for example, the ring alignment flange 76. The spacer 122 effectively occupies axial space between the ring alignment flange 76 and the inner diffuser case 112 to minimize axial movement of the clearance control ring 64. Radial movement of the clearance control ring 64 is limited due to the placement of the clearance control ring 64 on the land 80.

The clearance control ring 64 may be mechanically unfastened from other components of the gas turbine engine 20. That is, no mechanical fasteners are used to secure the clearance control ring 64 as mechanical fasteners may alter the mass of the clearance control ring 64. Mechanically fastened structures, such as bolted assemblies, may also increase assembly complexity and may induce stress concentrations verses mechanically unfastened assemblies.

During engine operation, core airflow heats the BOAS assembly 68 and the clearance control ring 64. The CTE differential between the clearance control ring 64 and the BOAS assembly 68 generally controls the radial movement of the BOAS assembly 68 and thus controls the radial tip clearances T.

Figure 3:
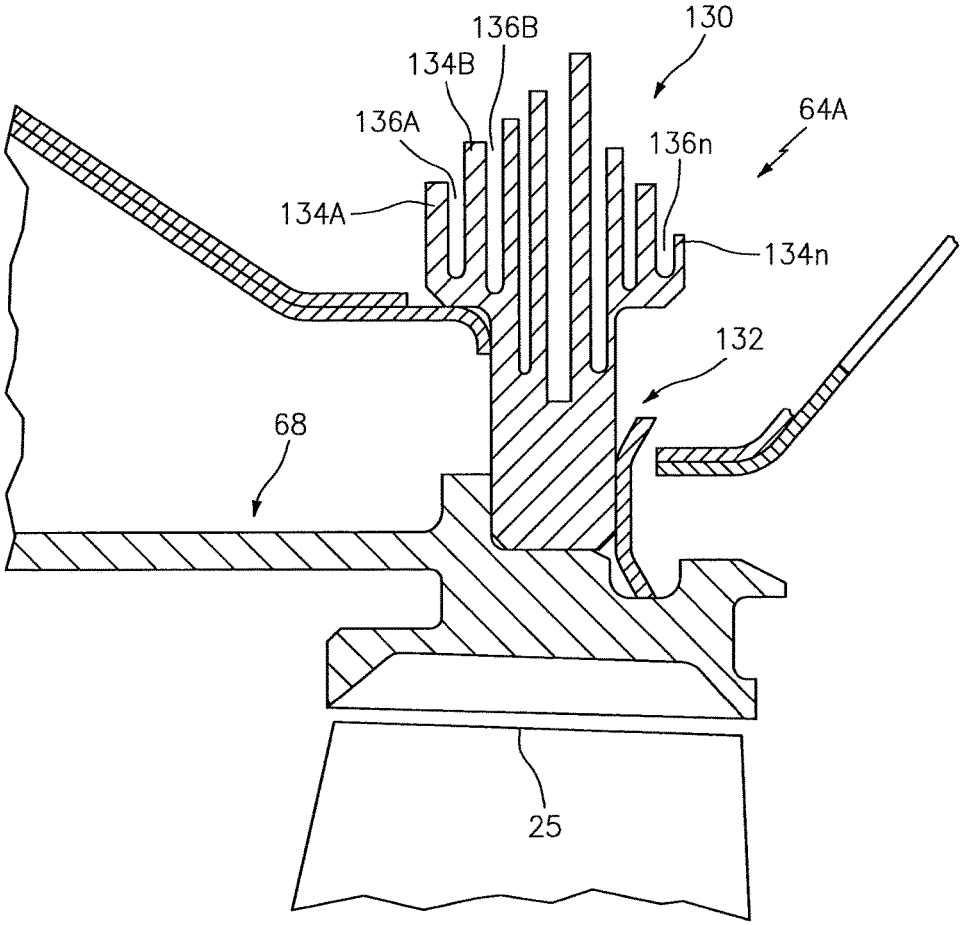
FIG. 3 is an enlarged partial sectional schematic view of a tailored clearance control ring according to one disclosed non-limiting embodiment.

With reference to FIG. 3, the clearance control ring 64A according to one disclosed non-limiting embodiment includes a contoured radial outer portion 130 and a radial inner portion 132. The contoured radial outer portion 130 has an axial thickness greater than the radial inner portion 132 and defines a multiple of fins 134A, 134B, . . . , 134*n* (eight shown) and a multiple of slots 136A, 136B, . . . , 136*n* (seven shown) to define an essentially "cactus" like contoured shape in cross-section. In this disclosed non-limiting embodiment, the multiple of fins 134A, 134B, . . . , 134*n* and the multiple of slots 136A, 136B . . . 136*n* are generally rectilinear in shape.

The multiple of fins 134A, 134B, . . . , 134*n* and the multiple of slots 136A, 136B, . . . 136*n* increase the surface area of the clearance control ring 64 yet maintains a desired radial height and mass required to control the radial movement of the BOAS assembly 68. That is, the multiple of fins 134A, 134B, . . . , 134*n* may be optimized in height and width for both transient thermal considerations and provide the mass necessary for steady state operations at that specific axial location along the clearance control ring 64 to provide a tailored response for the entire thermal envelope response.

The multiple of fins 134A, 134B, . . . , 134*n* allow for relatively quicker growth of the clearance control ring 64 yet maintain the mass required for steady state operations. Optimization of the transient growth as well as the steady state diameter is thereby provided in the single clearance control ring 64. Also, the axial thermal gradient for both transient (fin area) and steady state (fin height) is readily tailored to each axial location.

For example, combat aircraft may be subject to rapid acceleration from cruise conditions. Evidencing the transient and steady state, such an acceleration could be from a steady-state cruise condition or could be a reburst wherein the engine had been operating close to full speed/power long enough for temperature to depart from equilibrium cruise conditions whereafter the engine decelerates back to a cruise speed, and then reaccelerates. Accordingly, the multiple of fins 134A, 134B, . . . , 134*n* may be designed for such anticipated non-equilibrium transient situations.

Figure 4:
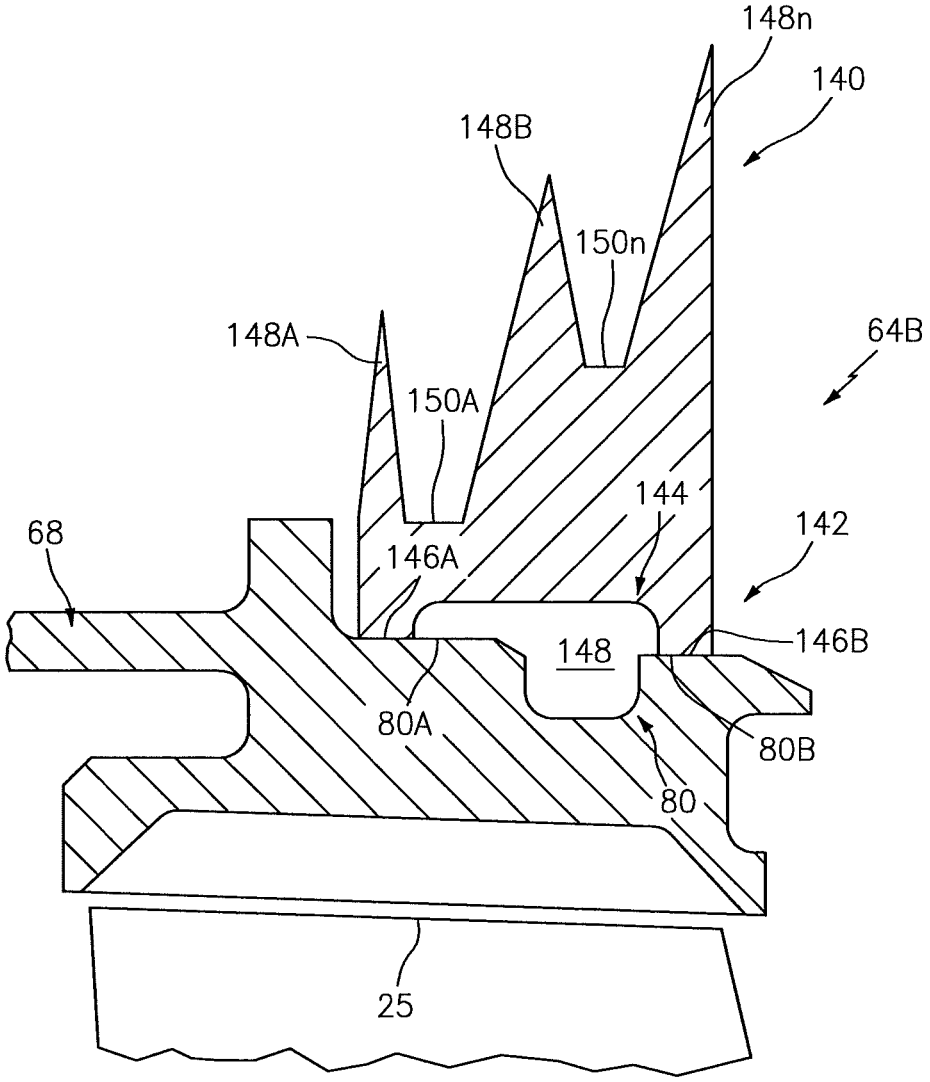
FIG. 4 is an enlarged partial sectional schematic view of a tailored clearance control ring according to one disclosed non-limiting embodiment.

With reference to FIG. 4, the clearance control ring 64B according to another disclosed non-limiting embodiment includes a contoured radial outer portion 140 and a radial inner portion 142. The radial inner portion 142 includes an inner surface 144 which is received on the land 80. The inner surface 144 defines a first foot 146A axially displaced from a second foot 146B which are respectively positioned upon onto a first control ring land 80A and a second control ring land 80B. The feet 146A, 146B also allow for multiple radial steps on the clearance control ring 64B to provide radial variation to the BOAS assembly 68.

The axially and/or radially displaced feet 146A, 146B and control ring lands 80A, 80B effect a radial displacement variation along the axial direction via a multiple of fins 148A, 148B, . . . , 148*n* and a multiple of slots 150A . . . 150*n* in the radial outer portion 140 of the clearance control ring 64B. That is, the multiple of fins 148A . . . 148*n* in this example, are of a radially increasing height from fin 148A to fin 148T such that a relatively greater radial force is applied to the second control ring land 80B relative to the first control ring land 80A to counteract aft radial outward roll of the BOAS assembly 68. In other words, the aft second control ring land 80B of the BOAS assembly 68 is subjected to a greater radial inward force from the clearance control ring 64B than the forward first control ring land 80A to control rolling of the BOAS assembly 68. In this disclosed non-liming embodiment, the multiple of fins 148A, 148B, . . . , 148*n* and a multiple of slots 150A, 150B, . . . 150*n* are generally triangular in shape to define respective peaks and valleys. It should be appreciated that various shapes will alternatively benefit therefrom.

The axially displaced feet 146A, 146B and control ring lands 80A, 80B also defines a cavity 148 which forms a "dead" annular cavity that minimizes the heat transfer from the relatively hot BOAS assembly 68 to the clearance control ring 64B through reduction of contact surface area. This permits a relatively less massive clearance control ring 64B to achieve a desired radial steady state position. The cavity 148 also facilitates reduced thermal conduction between the axially displaced feet 146A, 146B and control ring lands 80A, 80B to further tune or otherwise optimize the overall system response.

The contoured clearance control ring expands the design space from mostly steady state operations, to the entire thermal transient response to facilitate both steady state and transient clearance requirements in the same thermal control ring. The contoured clearance control ring also allows for optimization with contour change late in the design cycle to allow adjustment.

The use of the terms "a" and "an" and "the" and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to the normal operational attitude of the vehicle and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed is:

1. A clearance control system of a gas turbine engine, comprising:

a clearance control ring with a radial inner portion from which a contoured radial outer portion extends, wherein the contoured radial outer portion defines a multiple of fins and a multiple of slots; and a blade outer air seal assembly with a clearance control ring land which receives the radial inner portion;

wherein the radial inner portion includes an inner surface with a multiple of feet;

wherein the clearance control ring land defines a multiple of lands, one for each of the multiple of feet; and wherein the multiple of lands and the multiple of feet define a closed cavity therebetween.

2. The system as recited in claim 1, wherein the blade outer air seal assembly is mechanically fastened to a gas turbine engine structure.

3. The system as recited in claim 1, wherein the clearance control ring and the clearance control ring land define an interference fit.

4. The system as recited in claim 1, wherein the multiple of feet are axially displaced.

5. A method of controlling a radial tip clearance within a gas turbine engine, the method comprising:

forming a multiple of fins and a multiple of slots of a clearance control ring;

wherein the multiple of fins and the multiple of slots are tailored for both steady state and transient clearance operations; and wherein the multiple of fins and the multiple of slots are further tailored to counteract a rolling motion of a blade outer air seal assembly.

6. The method as recited in claim 5, further comprising:

locating the multiple of fins and the multiple of slots in a contoured radial outer portion of the clearance control ring;

wherein the contoured radial outer portion extends from a radial inner portion that includes an inner surface with a multiple of feet.

7. The method as recited in claim 6, further comprising forming a closed cavity between the multiple of feet and a multiple of lands.

* * * * *